US009887035B2

(12) United States Patent
Moreno Vallejo et al.

(10) Patent No.: US 9,887,035 B2
(45) Date of Patent: Feb. 6, 2018

(54) HIGH-VOLTAGE, HIGH-FREQUENCY AND HIGH-POWER TRANSFORMER

(71) Applicant: SOCIEDAD ESPANOLA DE ELECTROMEDICINA Y CALIDAD, S.A., Algete (Madrid) (ES)

(72) Inventors: Ildefonso Moreno Vallejo, Algete (ES); Francisco Diaz Carmena, Algete (ES); Angel Diaz Carmena, Algete (ES)

(73) Assignee: Sociedad Espanola De Electromedicina Y Calidad, S.A., Algete (Madrid) (ES)

( * ) Notice: Subject to any disclaimer, the term of this patent is extended or adjusted under 35 U.S.C. 154(b) by 271 days.

(21) Appl. No.: 14/437,599

(22) PCT Filed: Jan. 28, 2014

(86) PCT No.: PCT/ES2014/070058

§ 371 (c)(1),
(2) Date: Apr. 22, 2015

(87) PCT Pub. No.: WO2015/114174

PCT Pub. Date: Aug. 6, 2015

(65) Prior Publication Data

US 2016/0020015 A1 Jan. 21, 2016

(51) Int. Cl.
*H01F 27/02* (2006.01)
*H01F 27/28* (2006.01)
(Continued)

(52) U.S. Cl.
CPC ..... *H01F 27/2823* (2013.01); *H01F 27/02* (2013.01); *H01F 27/12* (2013.01);
(Continued)

(58) Field of Classification Search
CPC ..... H01F 7/202; H01F 38/30; H01F 27/02; H01F 27/324; H01F 30/16
(Continued)

(56) References Cited

U.S. PATENT DOCUMENTS 2,911,604 A * 11/1959 Krause ..... H01F 27/022 336/196
2,925,499 A * 2/1960 Johannes ..... H05G 1/06 378/104
(Continued)

OTHER PUBLICATIONS

International Search Report dated Oct. 17, 2014.

*Primary Examiner* — Alexander Talpalatski
*Assistant Examiner* — Joselito Baisa
(74) *Attorney, Agent, or Firm* — William H. Honaker; Dickinson Wright PLLC

(57) ABSTRACT

High-voltage, high-frequency and high-power transformer having a core (1) on which a primary winding (2) is disposed on which a secondary winding (4) is disposed in an insulated manner, whereupon the entire assembly is housed and mounted in an insulator (3), wherein the insulator (3) is made up of two parts or halves (6) and (7) symmetrical with respect to a transverse vertical plane, each part having a hollow tubular element (3.1) housed inside an outer housing (3.2) of each half of the insulator, defining in each part an annular space (3.3) comprised between the outer wall of the tubular element (3.1) and the inner wall of the outer housing (3.2), where the secondary or high-voltage winding is disposed, the insulator (3) presenting in its outer housing (3.2) a slot (5), which is situated at zero volts level, and though which the oil penetrates towards the secondary winding.

10 Claims, 4 Drawing Sheets

(51) Int. Cl.

| | |
|---|---|
| ***H05G 1/08*** | (2006.01) |
| ***H01F 27/12*** | (2006.01) |
| ***H01F 27/32*** | (2006.01) |
| ***H01F 27/24*** | (2006.01) |
| *H05G 1/06* | (2006.01) |
| *H01F 5/02* | (2006.01) |

(52) U.S. Cl.
CPC ..... *H01F 27/24* (2013.01); *H01F 27/324* (2013.01); *H05G 1/08* (2013.01); *H01F 2005/025* (2013.01); *H05G 1/06* (2013.01)

(58) Field of Classification Search
USPC ..... 336/90, 92, 98; 361/600
See application file for complete search history.

(56) References Cited

U.S. PATENT DOCUMENTS 3,082,389 A * 3/1963 Settles ..... H01F 38/30 336/173
3,290,469 A * 12/1966 Leeds ..... H01H 33/32 218/60
4,091,349 A * 5/1978 Niederjohn ..... H01F 5/02 336/192
4,178,677 A * 12/1979 Weisse ..... H01F 6/06 118/50
4,459,576 A * 7/1984 Fox ..... H01F 17/062 336/229
5,003,452 A 3/1991 Sireul et al.
5,060,253 A * 10/1991 Jedlitschka ..... H05G 1/06 363/61
5,257,304 A * 10/1993 Sireul ..... H05G 1/10 363/59
5,838,220 A * 11/1998 Hagberg ..... H01F 41/12 336/206
6,018,239 A * 1/2000 Berkcan ..... G01R 15/181 324/127
6,115,236 A 9/2000 Jedlitschka et al.
6,753,749 B1 * 6/2004 Chin ..... H01F 27/027 336/83
6,893,907 B2 * 5/2005 Maydan ..... H01J 37/321 438/149
7,097,447 B2 * 8/2006 Pianezze ..... F23Q 3/00 336/180
8,013,706 B2 * 9/2011 Simon ..... H04B 5/0093 336/119
8,188,823 B2 * 5/2012 Le ..... H01F 27/02 336/83
8,487,733 B2 * 7/2013 Chu ..... H01F 3/10 336/212
8,624,697 B2 * 1/2014 Shang ..... H01F 27/306 336/178
2006/0012457 A1 * 1/2006 Reppe ..... H01F 27/027 336/212
2011/0148433 A1 * 6/2011 Blank ..... H01F 27/321 324/555

* cited by examiner

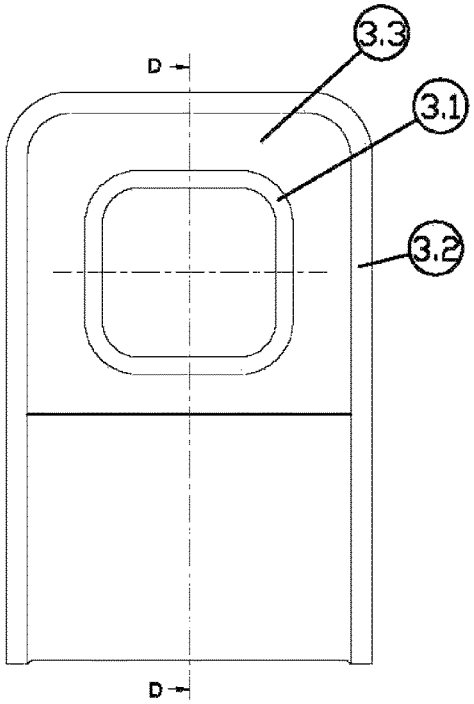
FIG 4.1
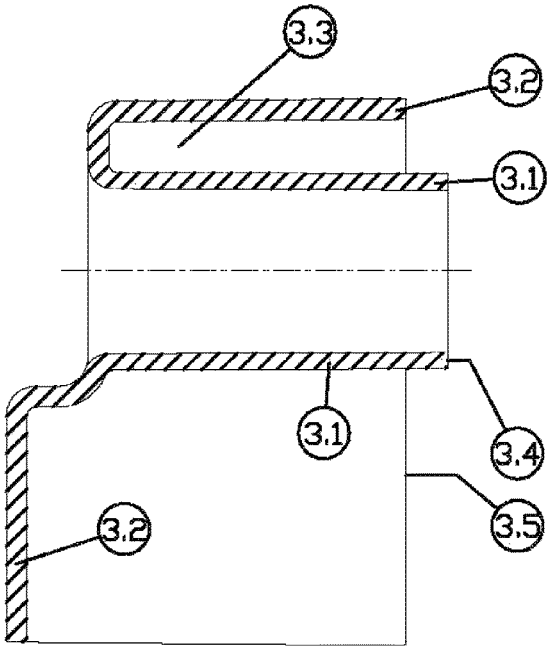
FIG 4.2

HIGH-VOLTAGE, HIGH-FREQUENCY AND HIGH-POWER TRANSFORMER

CROSS REFERENCE TO RELATED APPLICATION

This application claims the benefit of PCT International Application Serial No. PCT/ES2014/070058 filed on Jan. 28, 2014 and entitled a "High-Voltage, High-Frequency and High-Power Transformer", the entire disclosure of which is incorporated herein by reference.

OBJECT OF THE INVENTION

The object of the present invention, as established in the title, is a high-voltage, high-frequency and high-power transformer.

The present invention is characterized by the special constructive characteristics of the insulator in particular, on which the core, the primary winding and the secondary winding are mounted, so as to achieve sufficient insulation between both windings, maximum magnetic coupling and the possibility of cooling the primary and secondary windings using oil, obtaining a transformer which can be adapted to the dimensions of an X-ray tube in a very small space.

Therefore, the present invention relates to the field of transformers, and particularly high-power, high-frequency and high-voltage transformers.

BACKGROUND OF THE INVENTION

In the current state of the art, designing and building a high-voltage or high-frequency or high-power transformer is not a problem. However, designing and building a transformer that includes these three characteristics simultaneously represents an enormous challenge, due to the conflicting requirements of each of the aforementioned characteristics.

A high-voltage transformer requires a high degree of insulation between its primary and secondary windings (large distance separating the high- and low-voltage windings or large thickness of the insulators). This separation between windings reduces the magnetic coupling between the two and therefore leakage reactance increases, limiting the power output.

A high-frequency transformer requires a very good coupling between the primary and secondary windings in order to achieve acceptable efficiency and for the power output not to be limited by a poorly efficient coupling (excessive reactance between the primary and secondary winding). To fulfil this requirement, the distance between the primary and secondary windings must be as short as possible (which is exactly the opposite to what is required for a High-Voltage transformer). Also, the higher the operating frequency, the better the coupling needs to be, because the reactance between the windings is directly proportional to the frequency.

A high-power transformer requires the impedance of the windings to be very small and the reactance between the two to be sufficiently low so as not to limit the power output. This reactance is minimized when the coupling between the primary and secondary windings increases, i.e. when the two windings are close to each other (which is exactly the opposite to what is required for a High-Voltage transformer). Moreover, the higher the power output or operating frequency, the better the coupling must be, because the reactance between the windings is directly proportional to the frequency.

Therefore, the object of the present invention is to develop a transformer which is simultaneously high-voltage, high-frequency and high-power, wherein the insulation and magnetic coupling requirements are such that the objectives pursued can be achieved by developing a transformer like the one described below, the essence of which is set out in claim one.

DESCRIPTION OF THE INVENTION

The object of the present invention is a high-voltage, high-frequency and high-power transformer in a very small space, which can be adapted to the dimensions of an X-ray tube, so that it can be assembled in a single module, so that the electric potentials coincide between them (equipotential installation) in this way reducing the weight and volume of the assembly for the purpose of making it more economical and efficient.

The transformer is immersed in oil (mineral or vegetable), which has two main objectives: to serve as an electrical insulator and as a coolant for the transformer's electrical and magnetic elements.

The transformer has a core on which the primary winding is mounted, whereupon this assembly is housed inside a hollow tubular element which forms part of an insulator.

The insulator is made up of two parts which are symmetrical with respect to a transverse vertical plane, each part or half having a hollow tubular element housed inside an outer housing of each half of the insulator, with one end of the hollow tubular element connected to the outer housing, in such a manner that the inner space of the hollow tubular element is connected to the exterior and in each half of the insulator an annular space is defined, comprised between the outer wall of the tubular element and the inner wall of the outer housing, where the secondary or high-voltage winding is disposed.

The hollow tubular element of each half of the insulator has the peculiarity of projecting with respect to the free edge of the outer housing, so that the two halves of the insulator are coupled together, the free ends of the hollow tubular elements remain in contact, while a slot is defined between the two outer housings, which will be situated at zero volts level, where a high degree of insulation is not necessary and, however, allows the oil flow to come into contact with the circuitry of the secondary winding.

Due to the described configuration, the following is achieved:

- The primary winding and the secondary winding longitudinally occupy the same space, which maximizes the magnetic coupling between the windings and therefore also minimizes the reactance between them, which allows maximization of power output.
- It allows the rectifier, filter and resistive divider of the secondary winding to be disposed very close together due to the fact that these are equipotential circuits and that they have the same potential along them.
- The distance between the primary and the secondary winding is minimized by means of the hollow tubular element that separates both windings, enabling good magnetic coupling without loss of insulation.
- The geometry of the outer housing of each half of the insulator makes it possible to form a slot situated at zero volts level where a high degree of insulation is not necessary and, however, allows the oil to come into contact with the secondary winding.

EXPLANATION OF THE DRAWINGS

In order to complement the description being made and with a view to contributing towards a better understanding of the characteristics of the invention, in accordance with a preferred embodiment thereof, a set of drawings is attached as an integral part of said description, where, in an illustrative and non-limiting manner, the following has been represented.

FIG. 10 shows the section obtained when the transformer is cut along the C-C line.

FIG. 4.1 shows a side view of one of the halves of the insulator.

FIG. 4.2 shows the section obtained when the insulator is cut along the D-D line.

PREFERRED EMBODIMENT OF THE INVENTION

Figure 1A:
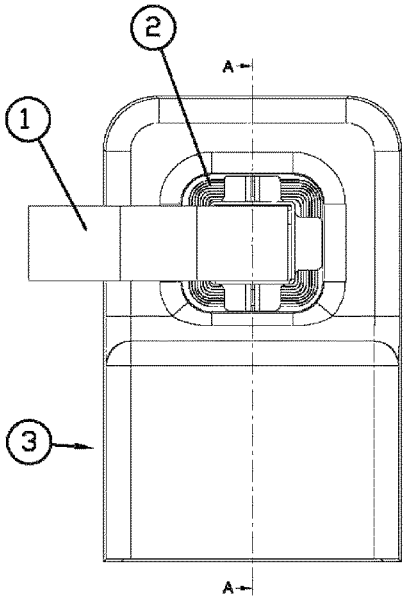
FIG. 1A shows a front view of the transformer object of the invention.

In light of the drawings, following is a description of a preferred embodiment of the proposed invention.

In FIGS. 1A, 1B, 10 and 1D it is possible to observe a magnetic core (1) on which the primary winding (2) is disposed having basic low-voltage insulation between them, because they both operate very near zero volts, which is the safety ground level (GND).

The primary winding (2) and magnetic core (1) assembly is housed in the interior of a hollow tubular element (8) defined in the insulator (3) of the transformer and, on said hollow tubular element (8), the secondary winding (4) is disposed. As can be observed, both the magnetic core (1) and the primary winding (2) are in direct contact with the oil, allowing the flow of oil through both magnetic core (1) and the primary winding (2) so that the oil evacuates the heat generated by the transformer operating losses.

Figure 1B:
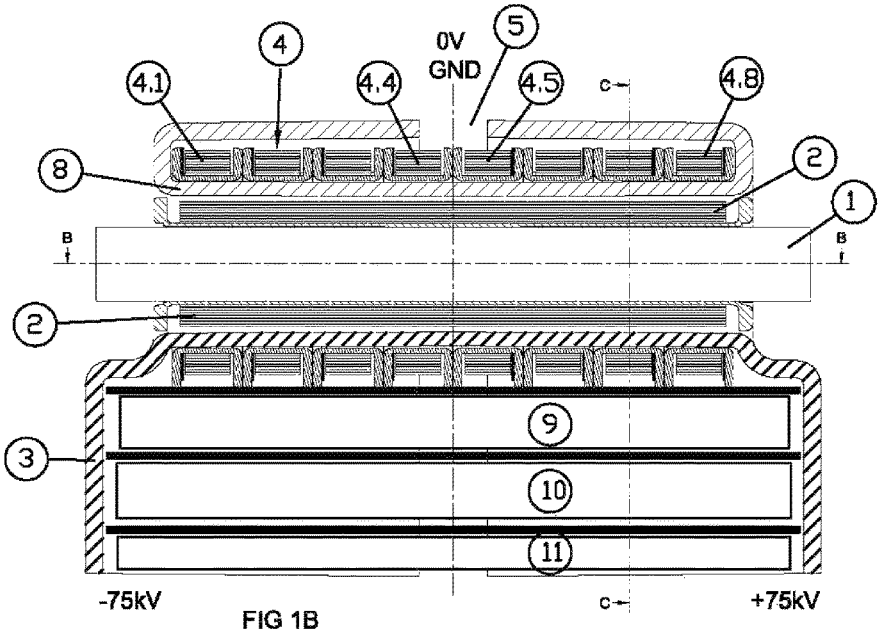
FIG. 1B shows the section obtained when the transformer of FIG. 1A is cut along the A-A line.
Figure 1C:
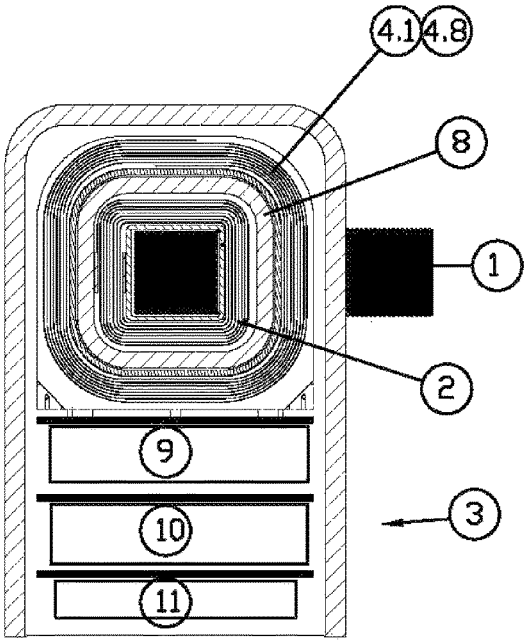
FIG. 1D shows the section obtained when the transformer is cut along the B-B line.
Figure 1D:
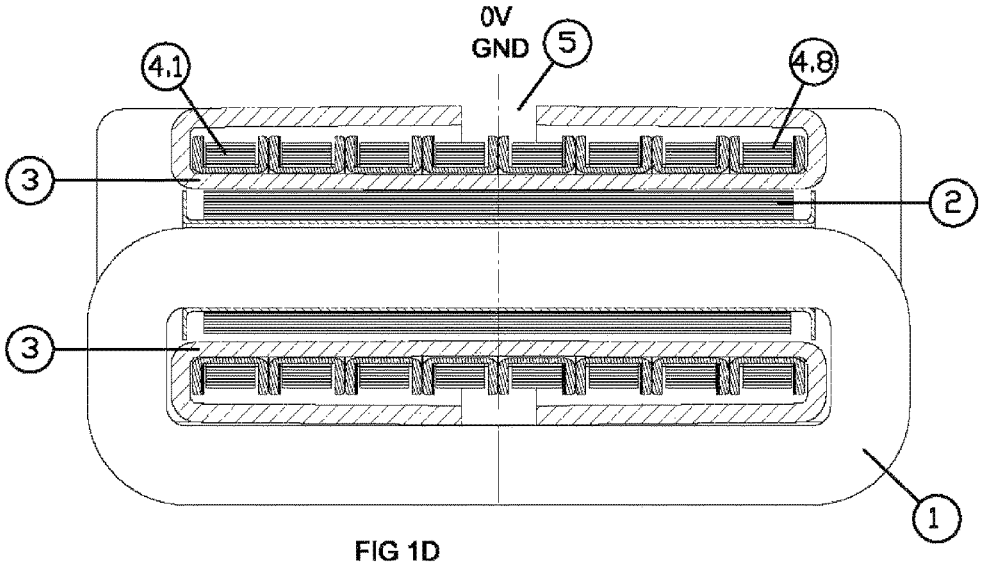

FIG. 1B shows how the secondary winding (4) is divided into different winding sections (4.1 to 4.8) that are wounded on independent coil formers. The voltage of these winding sections are rectified, filtered and serially connected to add all the voltages of each winding section by means of the rectifier (9) and filter (10). The resistive divider (11) takes a sample of the output voltage and feeds it back into the control circuit, thereby providing absolute and precise control of the output voltage.

In this same figure, it can be observed that the zero volts voltage (ground level or GND) is fixed exactly in the center of the secondary winding (between winding sections 4.4 and 4.5), where the insulator (3) has an opening (5) to allow the oil to flow toward the interior of the insulator (3), thereby insulating and cooling the circuitry of the secondary winding, which is disposed on the high voltage side. This opening is not detrimental to the transformer's insulation, because it is disposed in the very low voltage zone, where the oil insulation is sufficient.

It can also be observed that the voltage of the transformer decreases progressively, so for a transformer of 150 KV with negative polarity on the left, it reaches a minimum value of −75 kV on the left end. In the same progressive manner, it increases linearly with positive polarity towards the right of the transformer, reaching a maximum value of +75 kV on the right end. Therefore, it provides −75 kV on the left, increasing linearly up to +75 kV on the right, giving a total difference in potential of 150 kV between both ends, with the zero volts potential (ground or GND) in the center of the transformer.

Both the rectifier (9) and the filter (10) and the resistive divider (11) have the same potential values. This means that there is no difference in potential between them and this allows them to be disposed close together as they are equipotential circuits.

It can be observed how the primary winding (2) and the secondary winding (4) formed by the winding sections (4.1) to (4.8) longitudinally occupy the same space to maximize the magnetic coupling between them and, thus, minimize the reactance between them, which will allow maximization of the power output.

Figure 2:
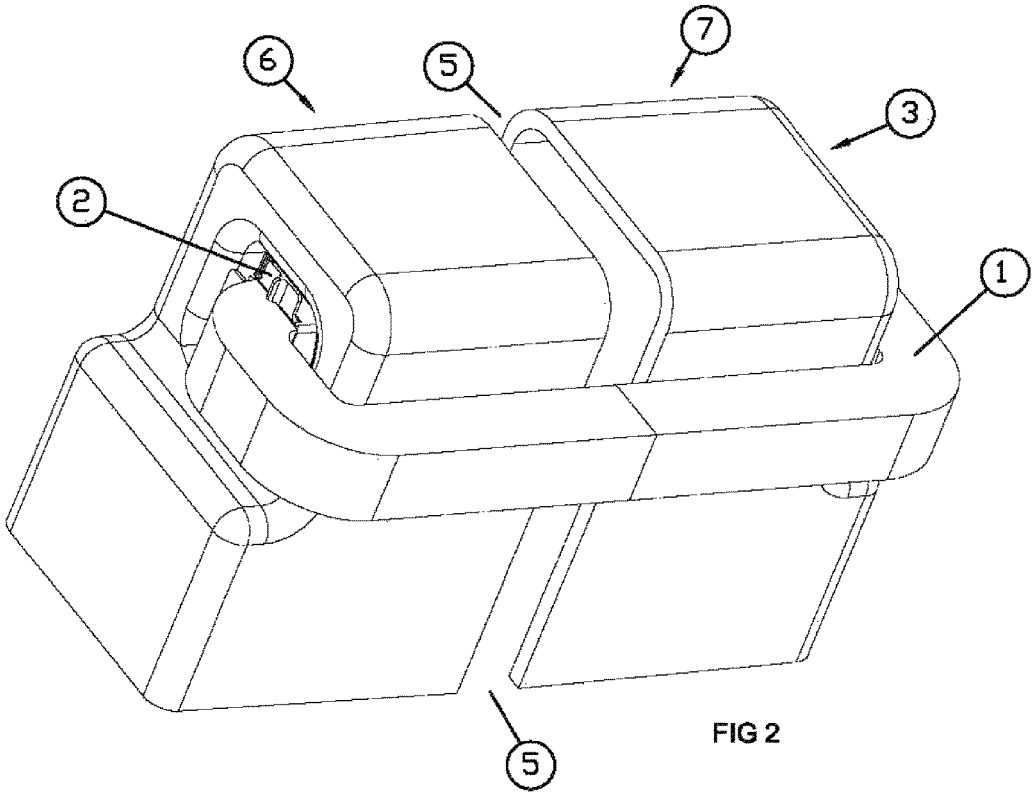
FIG. 2 shows a perspective view of the transformer.
Figure 3:
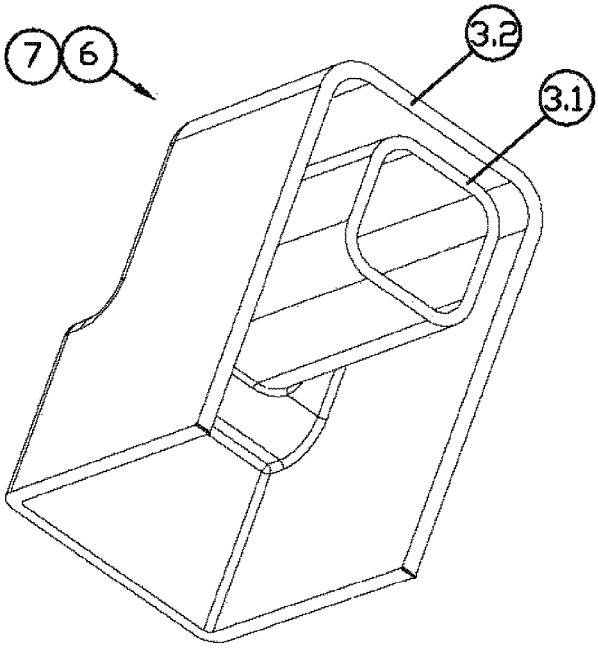
FIG. 3 shows an axonometric view of one of the halves of the insulator.

In FIGS. 2, 3, 4.1 and 4.2 it is possible to observe the constructive characteristics of the insulator (3) which, as can be observed, comprises two halves or parts (6) and (7), which are symmetrical with respect to a vertical plane to the insulator (3). Each of the parts or halves (6) and (7) comprises a hollow tubular element (3.1) in which the assembly formed by the core (1) and the primary winding (2) is housed. Enveloping each of the hollow tubular element (3.1) from each halve (6) and (7), there is an outer housing (3.2), with one end of the hollow tubular element (3.1) connected with the outer housing (3.2). An annular space (3.3) is defined between the hollow tubular element (3.1) and the outer housing (3.2), in which the secondary winding (4) is disposed.

Another characteristic of the insulator (3), and particularly of the tubular element (3.1) of each half (6) and (7), is that it has a length such that at its free edge (3.4), it is longer than the free edge (3.5) of the outer housing (3.2) (FIG. 4.2). When both halves (6) and (7) are coupled together, the free edges (3.4) of the hollow tubular elements (3.1) come into contact, and then between the free edges (3.5) of the outer housing (3.2) there is a gap or slot (5) (FIG. 2), thought which the cooling oil penetrates to the secondary winding (4) housed in the annular space (3.3).

The insulation between the primary winding (2) and secondary winding (4) is achieved by the tubular element (8) formed by the hollow tubular elements (3.1) of each half (6) and (7) of the insulator (3). The thickness of the hollow tubular elements (3.1) is such that it allows, on the one hand, insulation between the two windings (primary and secondary) and, on the other, a good magnetic coupling.

The outer housing (3.2) of each one of the halves of the insulator (3) allows the insulation of the secondary winding (4), and that the oil flows through the circuitry of the secondary winding (4) therefore cooling it.

With the described characteristics, it has been possible to achieve, inter alia, a high-voltage (150 kV), high-frequency (between 50 kHz and 150 kHz) and high-power (80 kW) transformer, in a very small space, in such a manner that it can be adapted to the dimensions of the X-ray tube, so as to assemble it in a single module, so that the levels of electric potential coincide between them (equipotential assembly), thereby reducing the weight and volume of the assembly for the purpose of making it more economic and efficient.

Having sufficiently described the nature of the present invention, along with the manner of putting it into practice, it is stated that, within its essentiality, it may be put into practice in other embodiments that differ in detail to that indicated by way of example, and to which the protection being applied for will likewise extend, provided that it does not alter, change or modify its basic principle.

The invention claimed is:

1. A high-voltage, high-frequency and high-power transformer having a core on which the primary winding is disposed, on which a secondary winding is disposed in an insulated manner, whereupon the entire assembly is housed and mounted in an insulator, wherein the insulator is made up of two parts which each make up a half of the insulator which are symmetrical with respect to a transverse vertical plane, each part having a single hollow tubular element housed in the interior of an outer housing of each half of the insulator and with one end of the hollow tubular element connected to the outer housing, so that the inner space of the hollow tubular element is connected to the exterior and an annular space is defined in each part comprised between the outer wall of the tubular element and the inner wall of the outer housing, where the secondary or high-voltage winding is disposed, wherein the hollow tubular element of each half of the insulator has the peculiarity of its free end projecting with respect to the free edge of the outer housing, it is longer than the free edge of the outer housing, in such a manner that, on coupling the two halves of the insulator, the free ends of the hollow tubular elements come into contact, while between the two outer housings, which is situated at zero volts level, there is a gap or slot, through which cooling oil penetrates to the secondary winding and through which the oil penetrates toward the secondary winding.

2. A high-voltage, high-frequency and high-power transformer, according to claim 1, wherein the secondary winding is divided into different winding sections which are wounded on independent coil formers and disposed in coaxial relationship with one another, whose voltage is rectified, filtered and serially connected to add all the voltages of each winding section by means of the rectifier and filter mounted next to the secondary winding.

3. A high-voltage, high-frequency and high-power transformer, according to claim 2, further including a resistive divider mounted next to the rectifier and the filter.

4. A high-voltage, high-frequency and high-power transformer, according to claim 3 wherein the primary winding and the secondary winding longitudinally occupy the same space.

5. A high-voltage, high-frequency and high-power transformer, according to claim 2 wherein the primary winding and the secondary winding longitudinally occupy the same space.

6. A high-voltage, high-frequency and high-power transformer, according to claim 1 wherein the primary winding and the secondary winding longitudinally occupy the same space.

7. A high-voltage, high-frequency and high-power transformer, according to claim 1 wherein the primary winding and the secondary winding longitudinally occupy the same space.

8. A high-voltage, high-frequency and high-power transformer, according to claim 1 wherein the tubular elements each extend perpendicularly to the plane and engage one another at the plane.

9. A transformer comprising:

a magnetic core;

a primary winding disposed about the magnetic core;

an insulator made up of two parts each having an exterior surface, an inner wall, and defining an interior and extending to a free edge;

a pair of hollow tubular elements each disposed in the interior of one of the parts and each having an outer wall;

each of the hollow tubular elements extending between a first end and a free edge;

the first end of each of the hollow tubular elements connected to the inner wall of one of the parts to define an annular space in the interior of each part between the outer wall of the tubular element and the inner wall of the part;

a secondary winding disposed about the hollow tubular elements in the annular space of each of the parts; and the free edge of each of the hollow tubular elements of each part extending past the free edge of the outer housing in such a manner that, upon coupling the two parts of the insulator together, the free edges of the hollow tubular elements come into contact, while between the two free edges of the outer housings, there is a gap or slot, through which cooling oil penetrates to the secondary winding and through which the oil penetrates towards the secondary winding.

10. A transformer comprising:

a magnetic core;

a primary winding disposed about the magnetic core;

an insulator made up of two parts each having an exterior surface, an inner wall, and defining an interior and extending to a free edge;

a pair of hollow tubular elements each disposed in the interior of one of the parts and each having an outer wall;

each of the hollow tubular elements extending between a first end and a free edge;

the first end of each of the hollow tubular elements connected to the inner wall of one of the parts to define an annular space in the interior of each part between the outer wall of the tubular element and the inner wall of the part;

a secondary winding disposed about the hollow tubular elements in the annular space of each of the parts; and the free edge of each of the hollow tubular elements of each part extending past the free edge of the outer housing whereby, upon coupling the two parts of the insulator together, the free edges of the hollow tubular elements come into contact with one another, defining a gap between the two free edges of the outer housings allowing a cooling oil to penetrates to the secondary winding and through which the cooling oil penetrates towards the secondary winding;

wherein the primary winding and the secondary winding longitudinally occupy the same space.

* * * * *